US010285490B2

(12) United States Patent
Coutant et al.

(10) Patent No.: US 10,285,490 B2
(45) Date of Patent: May 14, 2019

(54) FASTENER SYSTEMS

(71) Applicant: The North Face Apparel Corp., Wilmington, DE (US)

(72) Inventors: Andrew Coutant, Dublin, CA (US); Matthew Edward Paduano, Orinda, CA (US); Christopher Tagumi, Oakland, CA (US); Gregory Dailey, San Mateo, CA (US)

(73) Assignee: The North Face Apparel Corp., Wilmington, DE (US)

( * ) Notice: Subject to any disclaimer, the term of this patent is extended or adjusted under 35 U.S.C. 154(b) by 72 days.

(21) Appl. No.: 15/654,640

(22) Filed: Jul. 19, 2017

(65) Prior Publication Data

US 2017/0311702 A1 Nov. 2, 2017

Related U.S. Application Data

(63) Continuation of application No. 14/881,789, filed on Oct. 13, 2015, now Pat. No. 9,750,328.

(Continued)

(51) Int. Cl.
*A45F 3/04* (2006.01)
*A44B 11/02* (2006.01)

(Continued)

(52) U.S. Cl.
CPC ..... *A45F 3/047* (2013.01); *A44B 11/006* (2013.01); *A44B 11/02* (2013.01); *A44B 11/04* (2013.01);

(Continued)

(58) Field of Classification Search
CPC .. Y10T 24/4093; A45F 3/047; A44B 11/2557; A44B 11/258; A44B 11/04; A44B 11/006; A44B 11/02; A45C 2013/025
See application file for complete search history.

(56) References Cited

U.S. PATENT DOCUMENTS 1,232,546 A * 7/1917 Holden ..... A44B 11/12 24/184
3,928,895 A 12/1975 Klink (Continued)

FOREIGN PATENT DOCUMENTS

EP 0 260 929 A2 3/1988
JP 54-037320 U1 3/1979

(Continued)

OTHER PUBLICATIONS

Extended European Search Report and Opinion for European Patent Application No. 16175912.1, dated May 15, 2017.

(Continued)

*Primary Examiner* — Robert Sandy
(74) *Attorney, Agent, or Firm* — Ganz Pollard, LLC

(57) ABSTRACT

An adjustable-length tensile member, for example, a strap for a wearable pack, can include a fastener member defining first and second apertures and a cross-member positioned therebetween. A strap can extend through the first aperture in a first direction, over the cross-member and through the second aperture in a direction opposite to the first direction. A cover plate can matingly engage with the fastener member to obscure a segment of the strap from view. Wearable packs can incorporate such adjustable-length tensile members. Methods for assembling such adjustable-length tensile members are also disclosed.

18 Claims, 11 Drawing Sheets

Related U.S. Application Data

(60) Provisional application No. 62/183,647, filed on Jun. 23, 2015.

(51) Int. Cl.
*A44B 11/00* (2006.01)
*A44B 11/04* (2006.01)
*A45C 13/02* (2006.01)

(52) U.S. Cl.
CPC ..... *A45C 13/02* (2013.01); *A45C 2013/025* (2013.01); *Y10T 24/4042* (2015.01); *Y10T 24/4093* (2015.01); *Y10T 24/44026* (2015.01)

(56) References Cited

U.S. PATENT DOCUMENTS

| | | | |
|---|---|---|---|
| 4,848,794 | A | 7/1989 | Mader et al. |
| 2012/0094576 | A1 | 4/2012 | Tedder |
| 2012/0198667 | A1 | 8/2012 | Falvai |

FOREIGN PATENT DOCUMENTS

| | | | |
|---|---|---|---|
| JP | 03084982 | U | 4/1991 |
| JP | 3165338 | U | 1/2011 |

OTHER PUBLICATIONS

English-Language translation of Notice of Reasons for Refusal for Japanese Patent Application No. 2015-256242, dated Feb. 28, 2017.
Non-Final Office Action dated Mar. 3, 2017, for U.S. Appl. No. 14/881,789, of Coutant, A., et al., filed Oct. 13, 2015.
English-language translation of Preliminary Rejection for Korean Patent Application No. 10-2016-0030700, dated May 23, 2017.
English-language translation of Decision to Grant for Japanese Patent Application No. 2015-256242, dated Oct. 31, 2017.
Partial Search Report for European Patent Application No. 16203776.6, dated Apr. 18, 2017.
Extended European Search Report and Opinion for European Patent Application No. 16203776.6, dated Jul. 27, 2017.
Extended European Search Report for European Application No. 17202258.4, dated Dec. 20, 6 pages.
Office Action with Machine Translation into English for Chinese Application No. 2016100072884, dated Sep. 14, 2018, 10 pages.

* cited by examiner

FASTENER SYSTEMS

RELATED APPLICATIONS

This application is a continuation of U.S. patent application Ser. No. 14/881,789, filed Oct. 13, 2015, which claims the benefit of and priority to provisional U.S. Patent Application No. 62/183,647, filed Jun. 23, 2015, each of which patent applications is hereby incorporated by reference in its entirety, for all purposes.

BACKGROUND

The innovations and related subject matter disclosed herein (collectively referred to as the "disclosure") generally pertain to fastener systems, and more particularly but not exclusively to adjustable tensioners for straps, with an integrated buckle for a strap of a mountable pack (e.g., a backpack, daypack, rucksack, knapsack, pannier, courier bag, brief case, motorcycle tank bag, etc.) being but one particular example of disclosed fastener systems.

Mountable (including but not limited to wearable) packs have been long known. Such packs typically have one or more compartments for storing a user's items and a mounting tether (e.g., a shoulder strap) configured to secure to, wrap around, or otherwise mechanically engage a suitable structure for supporting or carrying the mountable pack during use and/or for storage. Typically, the compartments are secured or otherwise closed by closure systems such as zippers, drawing string systems, snap fasteners, hook and loop fasteners, etc. Many conventional mounting tethers are configured to provide an adjustable length for tailoring a given mountable pack to any of a variety of desired applications. However, conventional mounting tethers expose unsightly adjustment components and excess lengths of straps.

Modern aesthetic preferences and consumer expectations weigh in favor of simple, uncluttered and "clean" looking devices. Thus, a need exists for fastener systems arranged to obscure one or more portions thereof from a user's and/or a bystander's view. A further need exists for components of fastener systems to have a built-in or integrated appearance, while retaining conventional functions.

SUMMARY

The innovations disclosed herein overcome problems in the prior art and address one or more of the aforementioned, or other, needs.

Innovative fasteners are disclosed. A first plate can define a first aperture and a second aperture positioned opposite each other relative to a cross-member. The first plate can define the cross-member. A second plate can be configured to matingly engage with the first plate. A tensioner can extend through the first aperture from a first side to an opposed second side of the first plate. The tensioner can extend over the cross-member and through the second aperture from the second side to the first side. When the first and the second plates are matingly engaged with each other, the second plate extends over the first and the second apertures and the cross-member is spaced from the second plate to permit the tensioner to slide relative to the first plate and to obscure a segment of the tensioner from view.

A third plate can matingly engage with the first plate from a side opposite the second plate. In some embodiments, the third plate defines a corresponding aperture sized to permit access to the first aperture and the second aperture in the first plate when the third plate is matingly engaged to the first plate.

Adjustable-length straps incorporating disclosed fasteners are disclosed. A core can have opposed first and second sides and define an aperture extending from the first side to the second side. A fastener member can define first and second apertures and a cross-member positioned therebetween. The fastener member can further define a flange extending outwardly of the first and second apertures and can so urge against the first side of the core as to align the first and second apertures of the fastener member with the aperture extending through the core. A strap can extend through the first aperture in the fastener member in a direction extending from the first side of the core to the second side of the core, over the cross-member and through the second aperture in the fastener member in a direction extending from the second side of the core to the first side of the core. A cover plate can be positioned adjacent the second side of the core and in mating engagement with the fastener member through the aperture in the core.

Methods of assembling disclosed fastener systems are disclosed. A hidden adjustment mechanism for adjusting a strap is but one example of such fastener systems. A strap can be fed through a first aperture defined by a fastener member, over a cross-member of the fastener member and through a second aperture defined by the fastener member. The second aperture can be positioned opposite the first aperture relative to the cross-member. A cover plate can be brought into a mating engagement with the fastener member to obscure the strap from view. The fastener member can be inserted into an aperture defined by a core. The act of matingly engaging the cover plate with the fastener member can include positioning the core between a flange defined by the fastener member and a flange defined by the cover plate. The cover plate can be affixed to a sleeve, and the core can be inserted into the sleeve. A portion of the sleeve can be positioned between the core and a flange defined by the cover plate. A back plate can be brought into mating engagement with the fastener plate such that another portion of the sleeve is positioned between a flange of the back plate and the flange defined by the fastener member.

Wearable packs incorporating adjustable straps are disclosed. A body can define a volume for the containment of articles. The body can generally have a height, width, and depth, and at least one body strap coupled to the body. An adjustable-length strap can have an adjustable tensile member and an adjustment mechanism with a cover plate. The cover plate can obscure a segment of the adjustable tensile member from view.

In some embodiments, the strap also has a core defining an aperture, a fastener member, and a cover plate arranged as disclosed herein to obscure at least a segment (or portion) of the adjustable tensile member from view.

These and other embodiments are described in more detail in the following detailed descriptions and the drawings. It is to be understood that other innovative aspects will become readily apparent to those skilled in the art from the following detailed description, wherein various embodiments are shown and described by way of illustration. As will be realized, other and different embodiments are possible and several details are capable of modification in various other respects, all without departing from the spirit and scope of the principles disclosed herein.

Accordingly the drawings and detailed description are to be regarded as illustrative in nature and not as restrictive. The appended claims, as originally filed in this document, or as subsequently amended, are hereby incorporated into this Summary section as if written directly in.

BRIEF DESCRIPTION OF THE DRAWINGS

Unless specified otherwise, the accompanying drawings illustrate aspects of the innovative subject matter described herein. Referring to the drawings, wherein like reference numerals indicate similar parts throughout the several views, several aspects of the presently disclosed principles are illustrated by way of example, and not by way of limitation, in detail in the drawings, wherein.

DETAILED DESCRIPTION

By way of reference to specific examples, the following describes various innovative principles related to fastener systems, and more particularly but not exclusively to aesthetically pleasing fastener systems for adjustable-length straps of the type commonly used in connection with bags or packs. Persons skilled in the art will recognize that many modifications and variations are possible in the details, materials, and arrangements of the parts and actions which have been described and illustrated in order to explain the nature of the inventive subject matter, and that such modifications and variations do not depart from the spirit and scope of the teachings and claims contained therein.

One or more of the disclosed principles can be incorporated in various system configurations to achieve any of a variety of corresponding system characteristics. The detailed description set forth below in connection with the appended drawings is intended as a description of various embodiments and is not intended to represent the only embodiments contemplated by the inventors. The detailed description includes specific details for the purpose of providing a comprehensive understanding of the principles disclosed herein. However, it will be apparent to those skilled in the art after reviewing this disclosure that one or more of the claimed inventions may be practiced without one or more of the illustrated details.

Stated differently, systems described in relation to particular configurations, applications, or uses, are merely examples of systems incorporating one or more of the innovative principles disclosed herein and are used to illustrate one or more innovative aspects of the disclosed principles. Thus, fastener systems having attributes that are different from those specific examples discussed herein can embody one or more of the innovative principles, and can be used in applications not described herein in detail. Accordingly, such alternative embodiments also fall within the scope of this disclosure.

The term "wearable pack," as used herein, refers broadly to wearable packs, including those with shoulder straps, along the lines of backpacks, rucksacks, daypacks, messenger bags, totes and other packs with one or more shoulder straps. The term "Backpack," unless context indicates otherwise, means a pack with a pair of shoulder straps.

Wearable Packs

Figure 1:
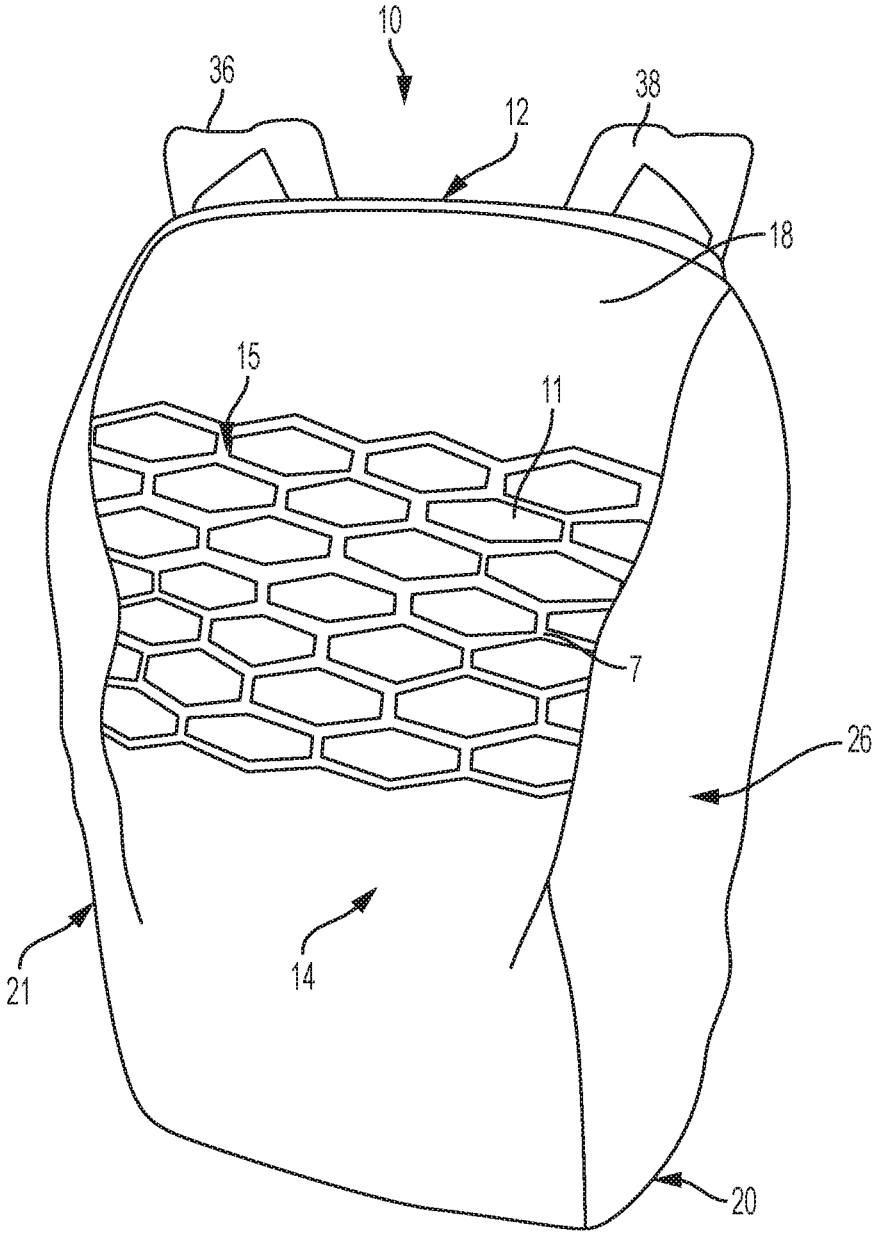
FIG. 1 shows a wearable pack incorporating shoulder-engaging straps representing but one particular example of disclosed adjustable-length tensile members.

FIG. 1 illustrates one possible embodiment of a wearable pack 10, which in this case is a backpack. The embodiment shown will generally be used to illustrate aspects of inventive subject matter, although disclosed innovations are not to be limited by them. The body 12 of the pack 10 has an overall construction of at least a front surface 14, a back surface 16, a top surface 18, a bottom surface 20, and side surfaces 24 and 26 that interconnect with the other surfaces. The arrangement of the surfaces defines one or more volumes, i.e., compartments, for containment of articles. In the context of surfaces 14, 16, 18, 20, 24, and 26, the term "surfaces" is used broadly to mean a generally sheet- or panel-like structure with a side that faces outward and a side that faces inward when assembled into the body of the pack. The surfaces need not come together in discrete joints; they may merge in curving interfaces, for example, and/or otherwise constitute a continuous (e.g., unitary) construct. Typically, the surfaces are made of a pliable material, such as one or more layers of a knit or a woven or non-woven textile, but the pack may be made in whole or part of shape-holding, semi-rigid or rigid materials, such as plastics, polymer foams, metals, and/or composites.

In at least the case of backpacks, the body is generally sized and shaped so that it fits comfortably against the back of the wearer. In some cases, a portion (e.g., back surface 16) may be contoured to conform to the contours of anatomy of a back. Generally, the body is dimensioned so as not to exceed about the width of the back, or the length between the waist and shoulders of the intended wearer. Backpacks may be sized and shaped differently to accommodate variations in height, e.g., small, medium, or large. Or they may be sized and shaped to fit gender or age categories, e.g., men, women, or children. Notably, the top side or bottom side surfaces or both could be essentially eliminated in whole or part by merging together the top edges of the front surface 14 and back surface 16, and/or the bottom edges of the front surface 14 and the back surface 16, creating wedges (not shown or present in the illustrated embodiment) where the surfaces join. Similarly, surfaces could be reduced in profile by using curves, for example, to merge surfaces. The side surfaces 24 and 26 could also be joined or merged in similar fashion. The surfaces are not necessarily continuous surfaces—zippers, netted sections, and cords may interrupt them for example.

The body strapping systems coupled to the wearable pack may be discrete items connected to the body or integrated structures with the body that are, for example, woven, knitted or molded in a unitary form with the body portion of the pack. The strap system may be a pair of shoulder straps, as is known in conventional backpacks, or a long, single strap that is configured to fit over one shoulder of and across a wearer's chest and under the arm opposite the shoulder, as is known in the case of bike messenger bags, for example. As used herein, "strap" is meant to refer to not only pliable, webbing and band-like structures but also individual filaments or bundles of filaments, chains, cords, cables, etc. that provide the functionality for the purposes described herein. A strap may have an elastic or inelastic construction. It may also have a construction of elastic and inelastic sections. The backpack shown in the drawings includes one or more shoulder straps, in the illustrated example, straps 36 and 38. The shoulder strap system can be based on single-ply straps of material or they can be a composite of materials, as is known in higher-end backpacks for carrying heavier loads. Often, the portion of the shoulder strap that bears against a wearer's body is made using a padded or cushioning material or construction. For example, it may be a composite of a cellular foam material, such as polyurethane, molded or cut EVA foam (ethylene-vinyl acetate), padded mesh—often known as nylon or polyester spacer mesh—surrounded by or joined to a fabric such as nylon.

Typically, the body of a pack includes a closeable opening for access to a compartment in the pack. In the embodiment shown, opening provides access at the top of the pack to a main compartment. The opening may extend down one or both sides of the pack to a desired degree. The opening may be secured in the closed condition by a closure system, such as a mechanism based on interlocking male/female parts, e.g., snaps; a zipper; hook and loop fasteners; buttons, etc., or another coupler.

The opening can be created by the separation of a portion of the pack from another portion. A front portion of the pack can be movable relative to a back portion.

The pack may have static frame elements that help support the pack in a desired configuration, such as a frame element, which helps keep the front portion and back portions of the pack separated, maintaining the structure and volume of the main compartment. The static frame element may be semi-rigid to allow some resilient flexibility to the back but still generally holding a compartment in a desired shape.

In addition to the main compartment, the body may include any number of other compartments for containment of articles. Other compartments may be arranged adjacent, side-to-side or up and down relative to the main compartment or to each other. The body, including any of its compartments, may also have pockets arranged on the inside or outside of the compartments. For example, a pocket (not shown) may also be arranged on the front of body 12. As used herein, "compartments" refers to relatively large areas for holding things such as, sleeping bags, laptops, articles of clothing, books, etc. Generally, "pockets" refers to relatively smaller areas for holding things, such as wallets, mobile phones, media players, water bottles, etc. However, there is not always a clear dividing line between what a compartment is and what a pocket is, beyond the main compartment of a pack. An optional backside-accessible compartment 35, separated from the main compartment 30, for storing an object such as a laptop 2. The compartment may be accessed by, for example a zipper system 37*a*, 37*b*.

In the embodiment shown, the pack has a dedicated compartment for storing a generally planar item, such as a laptop or tablet computer (hereinafter, collectively referred to as a "device") compartment that can be accessed on the back panel. Access to that compartment may be provided via a zipper running from part way up one side, around the top, to part way down the other side. The laptop compartment zipper can be spaced apart from the straps, so access is secure yet easy. In some instances, the size of a compartment for a laptop or tablet computer should be configured to have a size that store and enclose a device with minimum dimensions of 20 cm (height) by 12 cm (width) by 10 cm (depth). It should be understand, the laptop or tablet storage compartment could be the main compartment or any other suitable compartment and the discussion herein of the ejection system applies to any such compartment. It should also be understood that an ejection system may be used not only with devices but and other kind of stored item.

In addition to the shoulder straps 36, 38 for carrying the body of the pack on the body of a wearer, the pack may also optionally include a handle or grip (not shown). Examples of adjustable straps are described more fully below.

The body 12 of a pack may be constructed of one or more plies of thin, pliable material. Typical pliable materials for use in the body include, natural and synthetic materials, Nylon fabrics, polyester fabrics, natural or synthetic rubber or rubber-like plies of material, animal hides (e.g., leather), cotton, canvas, hemp, wool, and fabric blends. These materials can be used singly or in combination with each other. The body may be formed using materials having continuous surfaces such as Nylon plain weave or twill fabric or perforated surfaces such as net or web structures.

Frame elements may be associated with the pliable materials or other body forming materials by incorporating them between layers or by affixing them on exterior or interior surfaces of the materials. Further, a panel or portion of the pack may be monolithically molded or otherwise formed of a rigid material to provide a rigid or semi-rigid structure.

Fastener Systems

Referring now to FIG. 1, the straps 36, 38 of some wearable packs are adjustable in length. Such adjustability can allow different-sized wearers to use a given pack, and can allow a given user to adjust a fit of the pack to accommodate loads of different sizes and weights.

Figure 2:
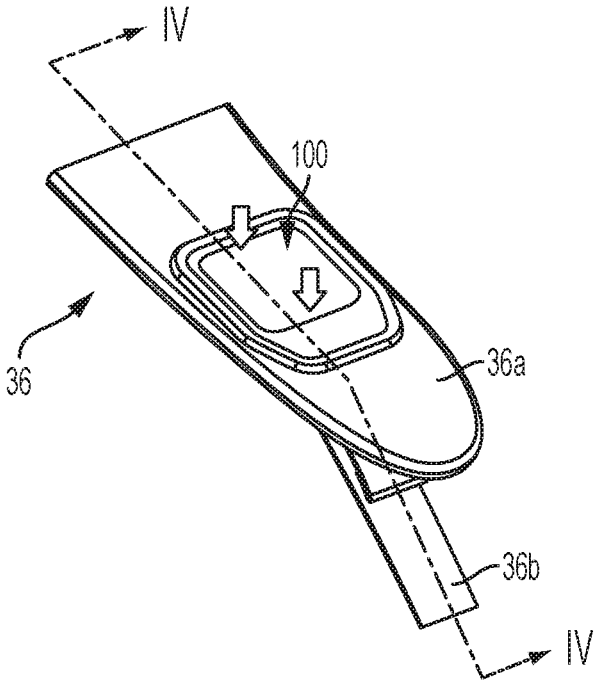
FIG. 2 shows an isometric view of an adjustment portion of a strap shown in FIG. 1.
Figure 3:
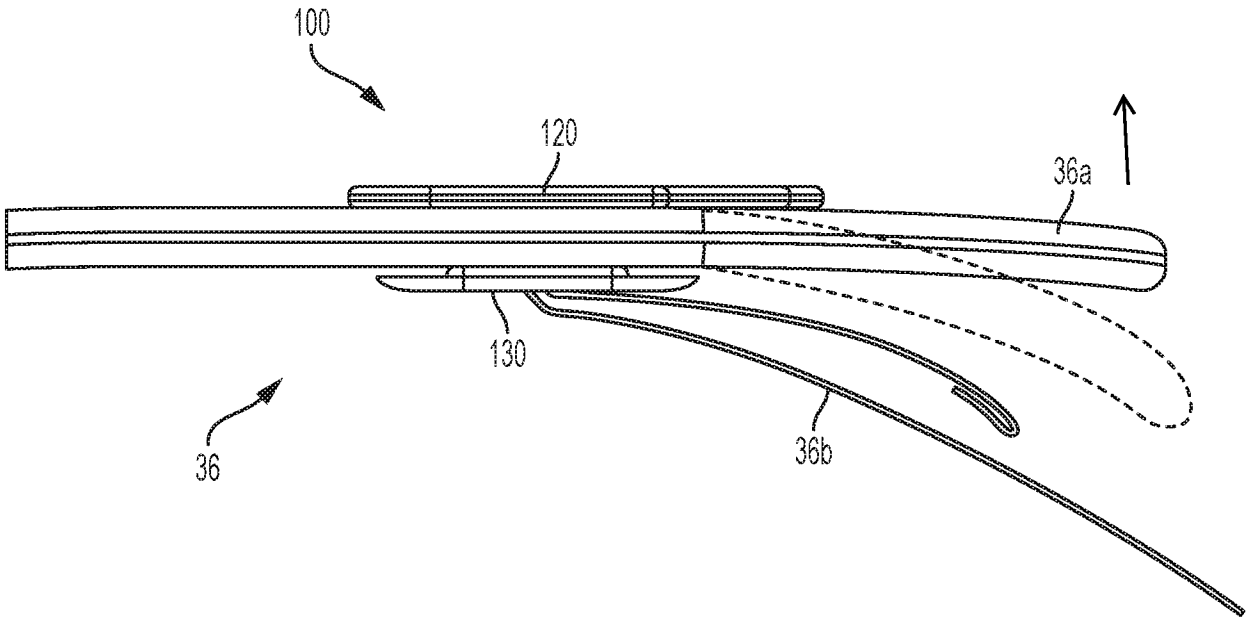
FIG. 3 shows a side elevation view of the adjustment portion shown in FIG. 2.
Figure 4:
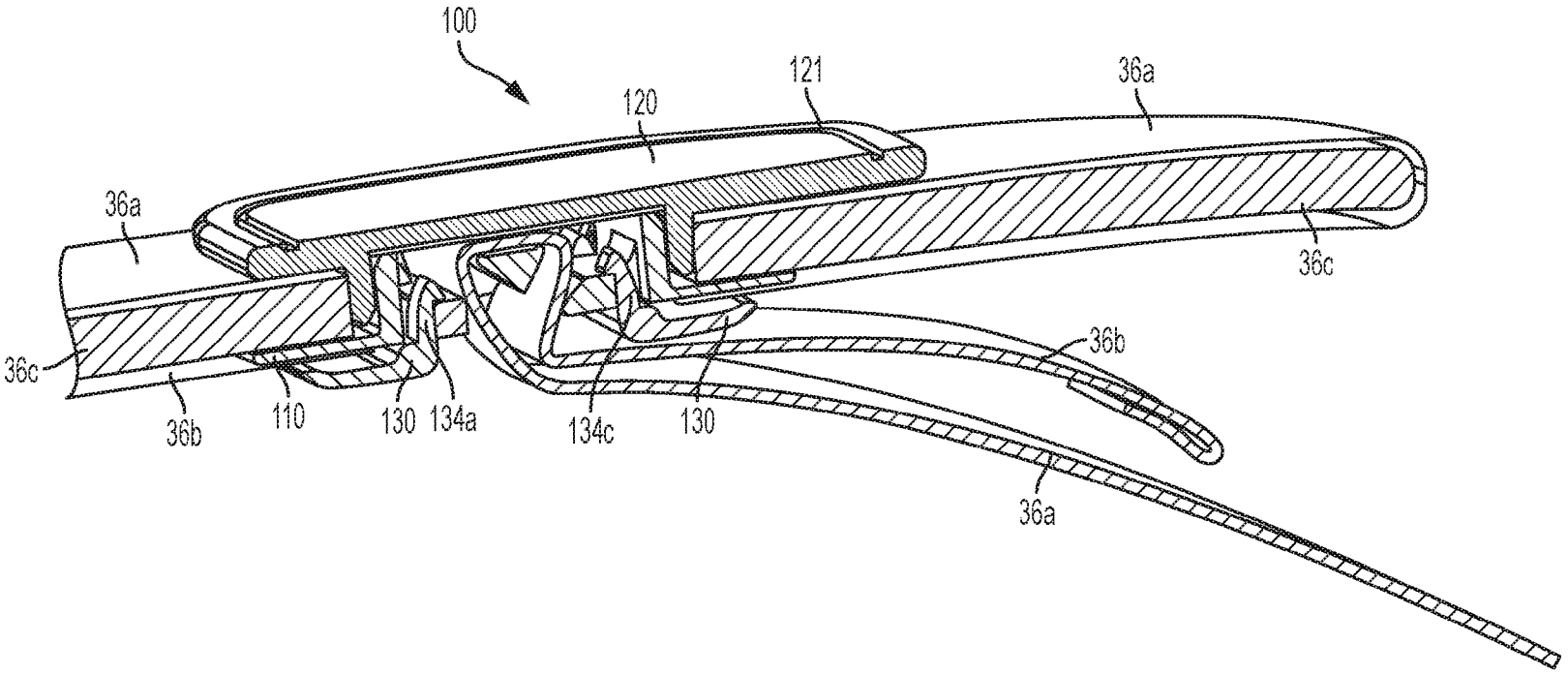
FIG. 4 shows a cross-sectional view of the adjustment portion shown in FIG. 2 taken along section IV-IV.

Referring generally to FIGS. 2-21, an adjustable-length strap 36 can have a shoulder-engaging portion 36*a*, an adjustment mechanism 100, and a separate strap 36*b*, or band, secured to the shoulder-engaging portion. As shown in FIG. 2, the adjustable portion 36*b* of the strap 36 can be obscured from view, as by the adjustment mechanism and/or the shoulder engagement portion 36'. In some disclosed embodiments, the adjustment mechanism 100 obscures at least a segment of the adjustable portion 36*b* of the strap from view, for example, as by a cover plate 120 (FIG. 4). In other examples, a portion of the strap can be made visible through an aperture 121' defined by the cover plate, as with the cover plate 120' shown in FIG. 8A. The strap 36*b* can be woven through the adjustment mechanism 100 in a slidable engagement, slidably coupling the strap 36*b* to the shoulder-engaging portion 36' to permit adjustment of the length of the strap 36.

The length of the strap 36 can be shortened, as by pulling on the loose end of the adjustable portion 36*b* of the strap (FIG. 3) to draw the adjustable segment through the adjustment mechanism 100. The length of the strap 36 can be lengthened, as by lifting a distal end of the shoulder engagement portion 36*b* away from the adjustable portion, as indicated by the arrow positioned adjacent reference numeral "36*a*" in FIG. 3, to draw the adjustable segment 36*b* through the adjustment mechanism.

The adjustment mechanism 100, by obscuring at least a segment of the strap 36*b* from a bystander's view, gives the strap "clean lines" with a pleasant, modern aesthetic, while retaining the ability to adjust a length of the strap 36 to accommodate different sizes of user and/or different loads in a pack.

The adjustment mechanism 100, sometimes also referred to as a fastener mechanism, or a "tension lock," slidably retains the strap 36*b* relative to the shoulder engaging portion 36' in the shoulder strap example shown in the drawings. Of course, in a more general sense, an adjustment mechanism 100 as disclosed herein can slidably retain any of various forms of a flexible tensile member relative to another member. Accordingly, throughout this disclosure and in the claims, use of terms "strap" and "shoulder engaging portion" shall be interpreted in the more general sense of a flexible tensile member and another member, respectively, unless expressly stated otherwise. More particularly, but not exclusively, examples of flexible tensile members include rope, twine, woven straps, metal cables, plastic bands, hoses, and elastic bands.

As shown in the cross-sectional view in FIG. 4, an adjustment mechanism 100 can have a first plate 110 that slidably receives the strap 36*b*. A second plate 120 matingly engages with the first plate 110 to obscure a segment of the strap 36*b* from view. For example, the segment of the strap 36 obscured from view in FIG. 2 includes the segment of the strap 36*b* woven through and engaging the first plate 110.

Fastener Plates

Figure 5:
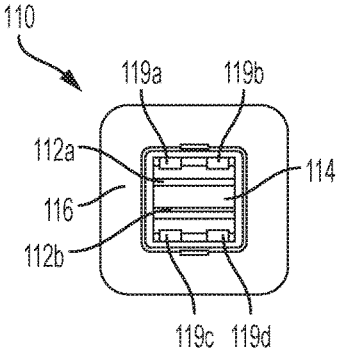
FIG. 5 shows a top plan view of a fastener member incorporated in the adjustment portion shown in FIG. 2.
Figure 6:
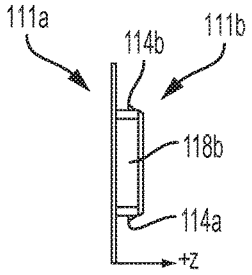
FIG. 6 shows a side elevation view of the fastener member shown in FIG. 5.
Figure 7:
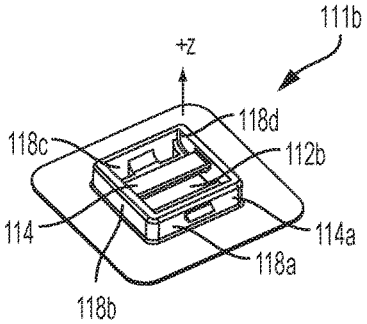
FIG. 7 shows an isometric view of the fastener member shown in FIG. 5.
Figure 9:
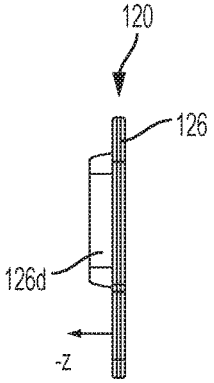
FIG. 9 shows a side elevation view of the cover plate shown in FIG. 8.
Figure 10:
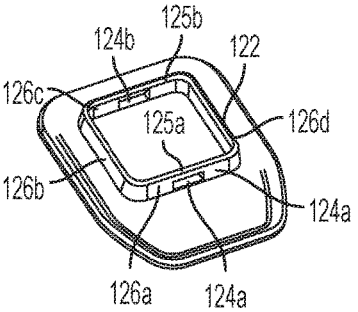
FIG. 10 shows an isometric view of the cover plate shown in FIG. 8.
Figure 11:
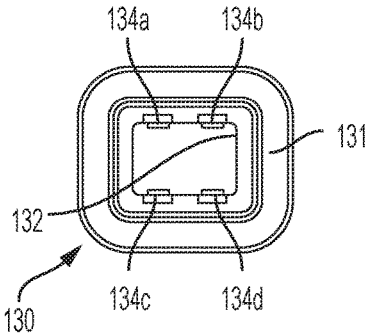
FIG. 11 shows a top plan view of a back plate incorporated in the adjustment portion shown in FIG. 2.
Figure 12:
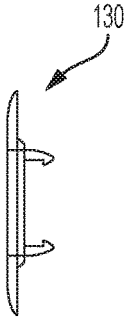
FIG. 12 shows a side elevation view of the back plate shown in FIG. 11.
Figure 13:
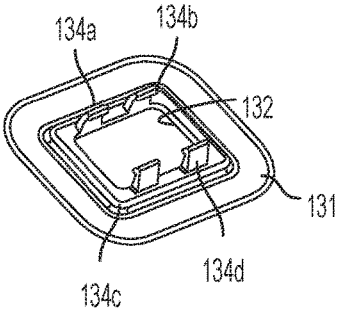
FIG. 13 shows an isometric view of the back plate shown in FIG. 11.

Referring to FIGS. 5 through 7, a fastener plate 110 arranged to slidably receive a strap 36*b* can define first and a second apertures 112*a, b* positioned opposite each other relative to a cross-member 114. A flexible tensile member 36*b*, sometimes also referred to as a tensioner in context of adjustable-length straps, can extend through the first aperture 112*a* from a first side 111*a* of the plate 110 to the second side 111*b*. As shown in FIG. 4, the tensioner can extend over the cross-member 114 as the tensioner passes from the first aperture to the second aperture 112*b*. The strap 36*b* can extend through the second aperture 112*b* from the second side 111*b* to the first side 111*a*.

Such an arrangement permits a user to easily shorten the effective length of the adjustable strap 36 by pulling on a free end of the strap 36*b*, while providing a secure and fixed-length when the strap 36 is placed under a tensile load. As shown in FIG. 4, a distal end 36*a* of the shoulder engagement portion can obscure or hide a fee end of the strap 36*b* from view by a bystander positioned in front of a wearer.

The fastener plate 110 can define a substantially planar flange 116 facing the second side 111*b*. As shown best in the cross-sectional view in FIG. 4 and the isometric view in FIG. 7, the cross member 114 can be spaced apart from the planar border region 116 in a direction extending normal from the flange, as the walls 118*a-d* extend from the flange. The walls 118*a, c* can be oriented substantially parallel to one or more of the first aperture 112*a*, the second aperture 112*b*, and the cross-member 114. In the exemplary embodiments shown in the drawings, the walls 118*a, c* extend parallel to all three.

The first plate 110 can define a coupler member configured to matingly engage with the cover plate 120. In the illustrated embodiments, the plate 110 defines at least one male coupler 114*a* and the cover plate 120 defines a corresponding at least one female coupler 124*a*. The male coupler and the female coupler are complementarily configured such that the male coupler 114*a* and the female coupler 114*b* engage each other when the first plate 110 and the second plate 120 are matingly engaged with each other, as shown in FIG. 1 and in the cross-sectional view in FIG. 4.

In the particular embodiments shown, the male coupler 114*a* is a boss extending from each of the walls 118*a* and 118*c*. The first wall 118*a* is positioned adjacent and parallel to the first aperture 112*a*. The second wall 118*c* is positioned adjacent and parallel to the second aperture 112*b*. The boss associated with the first wall 118*a* extends outwardly from the wall in a direction opposite the first aperture 112*a*. A second boss extends from the second wall 118*c* in a direction opposite the second aperture 112*b*.

As shown best in FIG. 5, the fastener plate 110 can define several apertures 119*a, b, c, d*. Each aperture can receive a corresponding extension 134*a, b, c, d* from a back plate 130 (shown in FIGS. 11-13 and described more fully below). The fastener plate 110 also can define a landing positioned adjacent each of the apertures 119*a-d* to permit a barb of each corresponding extension 134*a-d* to urge against and thereby retain the plate 130 in a mating engagement with the fastener plate, as shown in FIG. 4.

Cover Plate

A cover plate 120 can overlie the second side 111*b* of the fastener plate 110 when the first and the second plates 110, 120 are matingly engaged with each other, as shown in FIGS. 2 and 4, for example. More particularly, when the first and the second plates 110, 120 are matingly engaged with each other, the second plate 120 extends over the first and the second apertures 112*a, b* and the cross-member 114 is spaced from the second plate. Such spacing can permit the strap 36*b* to pass between the cross-member 114 and the cover plate 120 as the strap slides over the cross-member and relative to the fastener plate 110. With such an arrangement, the cover plate 120 obscures at least a segment of the strap 36*b*, as indicated in FIG. 2.

Figure 8:
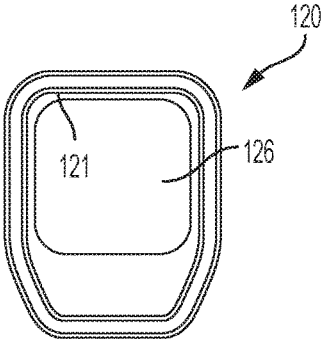
FIG. 8 shows a top plan view of a cover plate incorporated in the adjustment portion shown in FIG. 2.
Figure 8A:
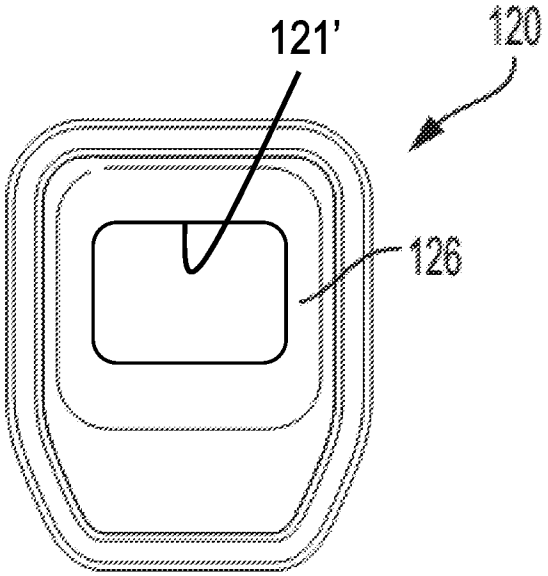
FIG. 8A shows a top plan view of a cover plate as in FIG. 8 defining an aperture.
Figure 15:
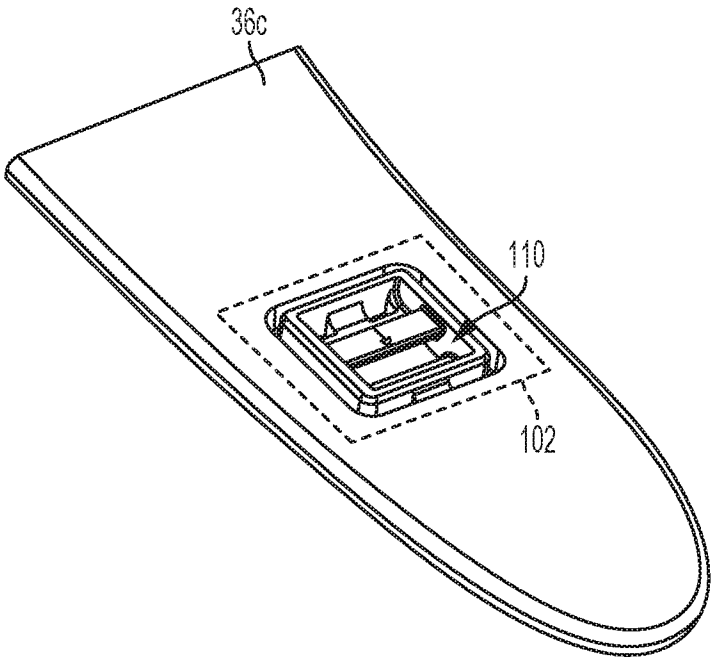
FIG. 15 shows an isometric view of the core and the fastener member shown in FIG. 14.
Figure 14:
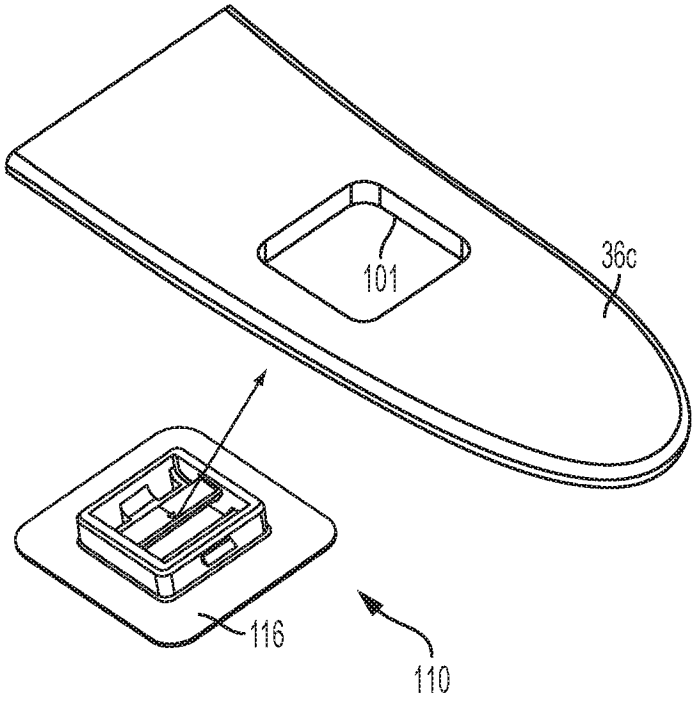
FIG. 14 shows an isometric view of a core of the adjustment portion shown in FIG. 2. Also shown is the fastener member shown in FIGS. 5, 6, and 7.
Figure 16:
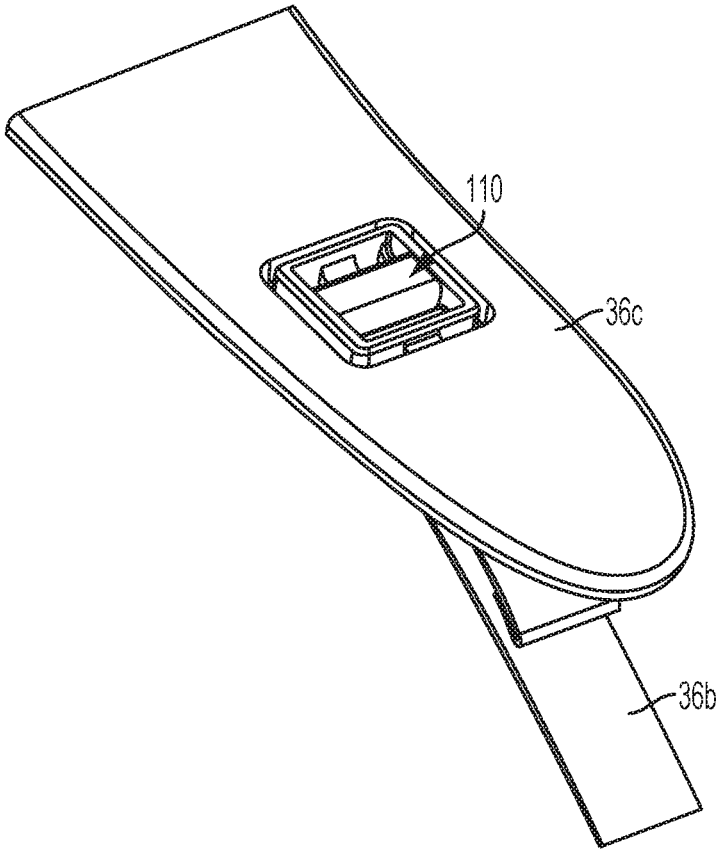
FIG. 16 shows an isometric view of the core and the fastener member as shown in FIG. 15, with a strap arranged in a slidable engagement with the fastener member.
Figure 17:
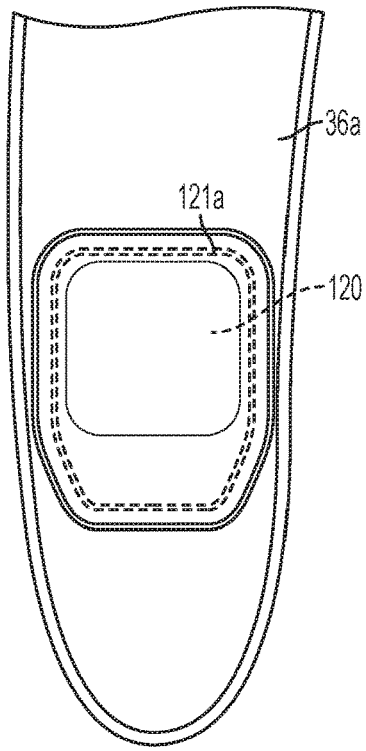
FIG. 17 shows a cover plate sewn on a sleeve.
Figure 18:
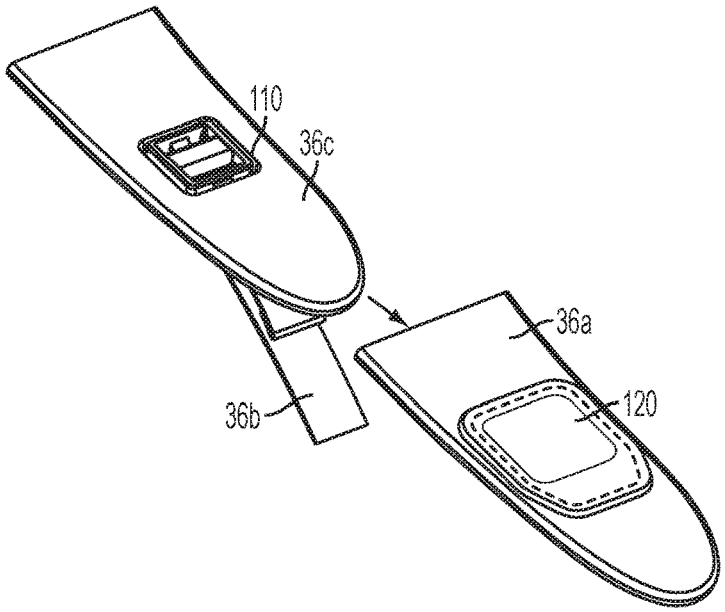
FIG. 18 shows the sleeve and cover-plate assembly in FIG. 17 ready to assemble with the core, fastener member and strap shown in FIG. 16.
Figure 19:
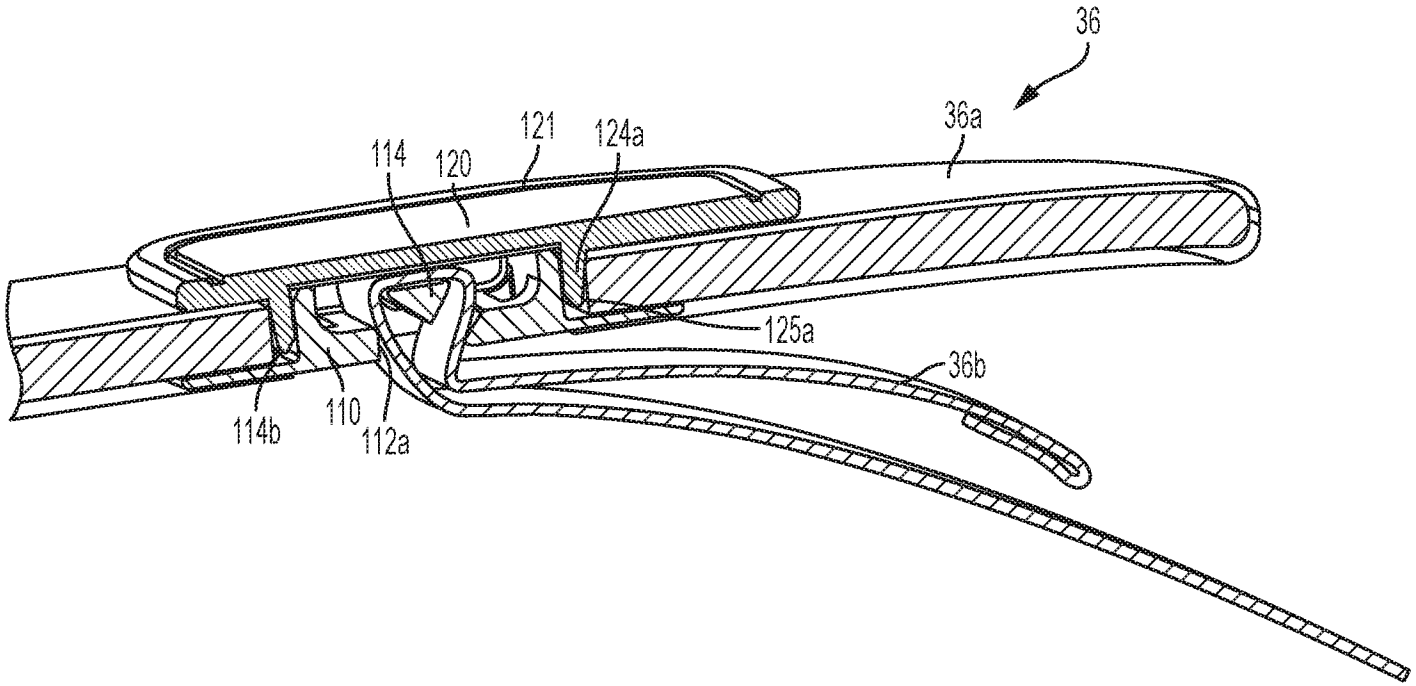
FIG. 19 shows a cross-sectional view of the sleeve and cover-plate assembly in FIG. 17 assembled with the core, fastener member and strap shown in FIG. 16. The plane of the cross-section is similar to the plane defined by section line IV-IV in FIG. 2.
Figure 20:
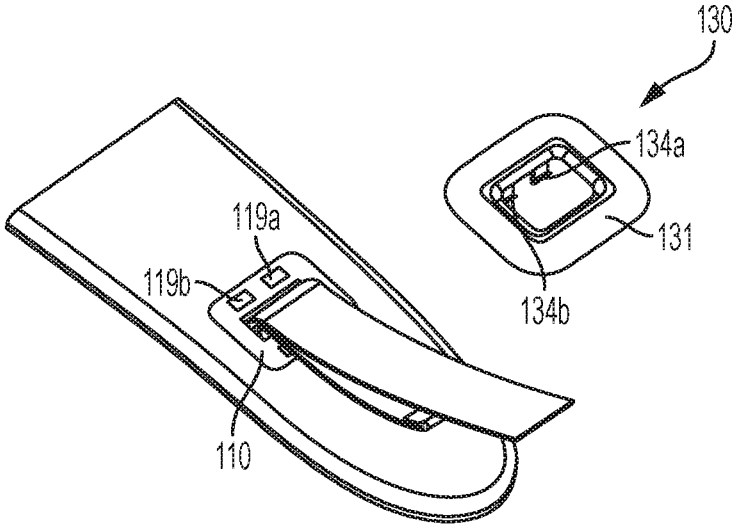
FIG. 20 shows an isometric view from below the assembled portion shown in FIG. 19, together with a back plate.
Figure 21:
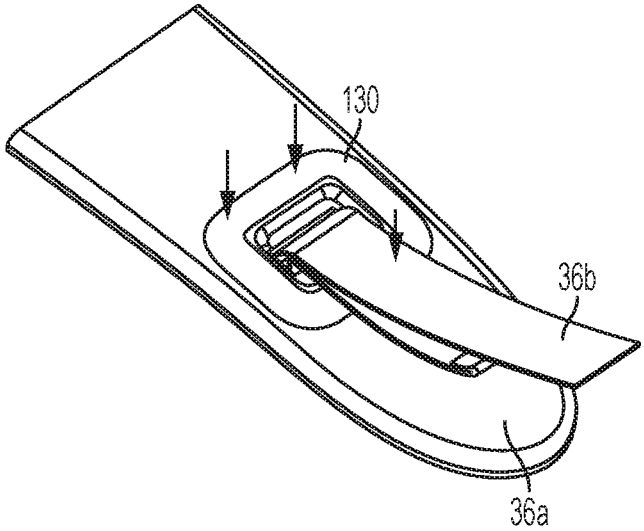
FIG. 21 shows the assembled portion shown in FIG. 20 with the back plate matingly engaged therewith.

A cover plate 120 can define a planar member 126 and opposed first and second walls 126*a, c* extending orthogonally from the planar member 126. The female coupler 124*a* that receives a corresponding male coupler defined by the fastener plate can be a recessed region defined by a respective one of the opposed first and second walls. One or more other of the walls can define a similar female coupler. Such an arrangement permits a mating engagement between the fastener plate 120 and the cover plate as indicated in FIGS. 2 and 4, for example. The planar member 126 can extend outwardly of the walls 126*a-d* to define an outer flange. As shown in FIG. 8A, the planar member 126 can define an aperture 121' extending therethrough. A portion of the adjustable strap 36*b* can be visible through the aperture 121'.

The outer flange can define a recessed channel 121. As will be described more fully below, the outer flange can be fixably attached, for example, to a sleeve, cover, sheath or other layer of material. In one embodiment, the outer flange is sewn to another member, with the stitching following a path defined by the channel 121, allowing an upper most surface of the stitching to remain recessed below an upper surface of the planar member 126, adding to a "clean" aesthetic and preventing or reducing the likelihood of wear to the stitching.

In some embodiments, a material can be co-molded or overmolded to the cover plate 120, such as to define the outer flange. The material can have one or more different characteristics relative to the material used to form the main body of the cover plate. For example, the co-molded or over-molded material can provide a different tactile feel compared to the material of which the main body is formed and/or can provide a different visual appearance. The co-molded or over-molded material can have a lower durometer or otherwise be suitable for stitching or otherwise attaching to the sleeve, cover, sheath or other layer of strap material. In some instances, the co-molded or over-molded material is relatively more suitable for stitching or otherwise attaching to the sleeve, cover, sheath or other layer of strap material compared to the material of which the main body is formed.

Back Plate

A backplate 130 can matingly engage with the fastener plate 110 from a side 111*a* opposite the cover plate 120. The back plate 130 can define a corresponding aperture 132 sized to permit the strap 36*b* to extend through the cover plate as it approaches the first aperture 112*a* in the fastener plate 110 and again as it extends from the second aperture 112*b* in the fastener plate.

Illustrated embodiments of the third plate 130 define one or more male couplers 134*a, b, c, d* extending from the third plate in a direction substantially orthogonal thereto. Each male coupler 134*a, b, c, d* can define a tapered barb having a landing region facing the surface 131 of the third plate 130 from which the respective male coupler extends. As noted above, the fastener plate 110 has a corresponding landing region positioned adjacent each respective aperture 119*a, b, c, d* through which a corresponding male coupler 134*a, b, c, d* of the third plate 130 can extend. The landing region of the tapered barb can urge against the landing region of the first plate when the third plate and the first plate are matingly engaged with each other. Such engagement is shown in the cross-section of FIG. 4.

As with the cover plate 120, the back plate 130 can define a flange 131 extending outwardly of the aperture 132. The flange 131 can be affixed or otherwise secured to a portion of the strap assembly 36, as will be described more fully below.

Assembly

Referring in particular to FIGS. 2, 4, 14, 15 and 18, an adjustable-length strap can have a core 36*c* with opposed first and second sides. The core 36*c* can define an aperture 101 extending from the first side to the second side.

A fastener member 110 of the type described above can be positioned with its flange 116 to urge against or otherwise engage or be secured to the first side of the core 36*c*. By positioning the walls 118*a-d* within the aperture 101 and mating the flange 116 with a surface of the core 36*c*, the first and second apertures 112*a, b* of the fastener plate 110 can be aligned with the aperture 101 extending through the core.

A strap 36*b* can extend through the first aperture 112*a* in the fastener member 110 in a direction extending from the first side of the core 36*c* to the second side of the core. As shown in FIG. 4, the strap 36*b* can extend over the cross-member 114 and through the second aperture 112*b* in the fastener member 110 in a direction extending from the second side of the core to the first side of the core.

A cover plate 120 can be positioned adjacent the second side of the core 36*c* in a mating engagement with the fastener plate 110 so the core 36*c* is positioned between the flange 116 of the fastener member and the flange defined by the planar member 126 of the cover plate.

The back plate 130 can have its aperture 132 aligned with the aperture 101 in the core 36*c* when the back plate matingly engages with the fastener plate 110. The back plate can mate with a side 111*a* of the fastener plate 110 opposite to the cover plate 126. The band 36*b* can extend through the aperture 132 in the back plate 130, as shown in FIG. 4.

In some embodiments, a sleeve 36*a* having opposed inner and outer major surfaces can overlie the core 36*c* such that the inner major surface of the sleeve faces the core 36*c* in an opposed relationship. The illustrated sleeve 36*a* defines an opening through which the walls of the cover plate 120 extend to permit the cover plate to matingly engage the fastener member 110. The flange 126 of the cover plate 120 can overlie a portion of the outer major surface of the sleeve 36*a*, so the sleeve is positioned between the flange 126 and the core 36*c*, placing the sleeve 36*a* and the core 36*c* between the flange 126 of the cover plate 120 and the flange 116 of the fastener member 110.

The flange 131 of the back plate 130 can also overlie a portion of the sleeve 36*a* such that the portion of the sleeve is positioned between the flange 131 of the back plate 130 and the fastener member 110.

Methods of assembling a hidden adjustment mechanism 100 for adjusting a length of a strap will now be described. A strap 36*b* can be fed through the first aperture 112*a* defined by the fastener member 110, over the cross-member 114, and through the second aperture 112*b*. The fastener member 110 can be inserted into an aperture 101 defined by the core 36*c*.

The cover plate 120 can be affixed to the sleeve 36*a*. The core 36*c* can be inserted into the sleeve 36*a*. The core 36*c* can be positioned between the flange 116 defined by the fastener plate 110 and the flange 126 defined by the cover plate 120. A portion of the sleeve 36*a* can be positioned between the core 36*c* and the flange 126 defined by the cover plate 120. The cover plate 126 can be matingly engaged with the fastener member 110 to obscure the strap 36*b* from view.

The strap 36*b* can be fed through the aperture 132 defined by a back plate 130. The back plate 130 can be matingly engaged with the fastener plate 110 such that another portion of the sleeve 36*a* is positioned between a flange 131 of the back plate 130 and the flange 116 defined by the fastener member 110. In some embodiments, the back plate is affixed to the sleeve 36*a*.

Other Embodiments

The examples described above generally concern fastener systems that permit length adjustment of flexible tensile members, and more particularly but not exclusively to adjustable-length straps for wearable packs. Nonetheless, other applications for disclosed concepts are contemplated, together with any attendant changes in configuration of the disclosed apparatus. For example, a belt or other strap can slidingly engage another member as described herein, and a cover plate can protect the belt or other strap from damage, as by abrasion, during an industrial use, during rock climbing, other use conventionally likely to cause accelerated wear and tear to a strap. Incorporating the principles disclosed herein, it is possible to provide a wide variety of systems configured to provide adjustable length for flexible tensile members.

Directions and references (e.g., up, down, top, bottom, left, right, rearward, forward, etc.) may be used to facilitate discussion of the drawings but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and "or." Moreover, all patent and non-patent literature cited herein is hereby incorporated by references in its entirety for all purposes.

The principles described above in connection with any particular example can be combined with the principles described in connection with any one or more of the other examples. Accordingly, this detailed description shall not be construed in a limiting sense, and following a review of this disclosure, those of ordinary skill in the art will appreciate the wide variety of fluid heat exchange systems that can be devised using the various concepts described herein. Moreover, those of ordinary skill in the art will appreciate that the exemplary embodiments disclosed herein can be adapted to various configurations without departing from the disclosed principles.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the disclosed inventions are not intended to be limited to the embodiments shown herein, but are to be accorded the full scope consistent with the language of this disclosure, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No element is to be construed under the provisions of 35 USC 112, sixth paragraph, unless the element is expressly recited using the phrase "means for" or "step for".

Thus, in view of the many possible embodiments to which the disclosed principles can be applied, it should be recognized that the above-described embodiments are only examples and should not be taken as limiting in scope. I therefore reserve all rights to the subject matter disclosed herein, including the right to claim any and all combinations of subject matter described herein, including but not limited to all that comes within the scope and spirit of the following claims.

The invention claimed is:

1. A fastener comprising:

a first plate defining first and second apertures positioned opposite each other relative to a cross-member;

a second plate configured to matingly engage with the first plate, wherein, when the first and the second plates are matingly engaged with each other, the second plate extends over the first and the second apertures and the cross-member is spaced from the second plate, wherein the first plate defines opposed first and second sides, and the second plate overlies the second side when the first and the second plates are matingly engaged with each other; and a tensioner extending through the first aperture from the first side to the second side, over the cross-member, and through the second aperture from the second side to the first side and a third plate configured to matingly engage with the first plate from a side opposite the second plate.

2. A fastener according to claim 1, wherein the third plate defines a corresponding aperture sized to permit access to the first aperture and the second aperture in the first plate when the third plate is matingly engaged to the first plate.

3. A fastener according to claim 2, wherein the tensioner extends through the aperture defined by the third plate.

4. A fastener according to claim 1, wherein the third plate defines one or more male couplers extending from the third plate in a direction substantially orthogonal thereto.

5. A fastener according to claim 4, wherein the first plate defines a female coupler having a complementary configuration relative to the one or more male couplers extending from the third plate.

6. A fastener according to claim 5, wherein female coupler comprises an aperture through which the male coupler of the third plate can extend.

7. A fastener according to claim 6, wherein the male coupler defines a tapered barb having a landing region facing the surface of the third plate from which the male coupler extends, wherein the first plate defines a corresponding landing region positioned adjacent aperture through which the male coupler of the third plate can extend, wherein the landing region of the tapered barb urges against the landing region of the first plate when the third plate and the first plate are matingly engaged with each other.

8. A fastener according to claim 7, wherein the at least one female coupler comprises a first female coupler, wherein the second plate comprises at least a second female coupler and the first and the second female couplers are positioned outward of the first and the second apertures of the first aperture.

9. A wearable pack, comprising:

a body defining a volume for containing articles, the body generally having a height, width, and depth;

at least one body strap coupled to the body;

a first plate defining first and second apertures positioned opposite each other relative to a cross-member;

a second plate configured to matingly engage with the first plate, wherein, when the first and the second plates are matingly engaged with each other, a portion of the at least one body strap is positioned between a respective portion of the first plate and a respective portion of the second plate to retain the first and the second plate relative to the at least one body strap, the second plate extends over the first and the second apertures of the first plate, and the cross-member is spaced from the second plate; and a tensioner extending through the first aperture, over the cross-member, and through the second aperture.

10. A fastener according to claim 9, wherein the first plate defines at least one male coupler and the second plate defines a corresponding at least one female coupler, wherein the male coupler and the female coupler are complementarily configured such that the male coupler and the female coupler engage each other when the first plate and the second plate are matingly engaged with each other.

11. A fastener according to claim 10, wherein the first plate defines a substantially planar border region facing the second side, wherein the cross member is spaced apart from the planar border region in a direction normal thereto, and wherein the first plate defines a wall extending from the planar border region and oriented substantially parallel to one or more of the first aperture, the second aperture, and the cross-member, wherein the at least one male coupler comprises a boss extending from the wall.

12. A fastener according to claim 11, wherein the wall comprises a first wall and is positioned adjacent and parallel to the first aperture, wherein the fastener further defines a second wall positioned adjacent and parallel to the second aperture, wherein the boss comprises a first boss extending from the first wall in a direction opposite the first aperture, wherein the at least one male coupler comprises a second boss extending from the second wall in a direction opposite the second aperture.

13. A fastener according to claim 12, wherein the second plate defines a planar member and opposed first and second walls extending orthogonally from the planar member, wherein the at least one female coupler comprises a first recessed region and a second recessed region, each being defined by a respective one of the opposed first and second walls.

14. The wearable pack according to claim 9, wherein:

the at least one body strap comprises a core defining an aperture having a corresponding periphery, the respective portion of the first plate comprises a first flange extending outwardly of the periphery and the respective portion of the second plate comprises a second flange extending outwardly of the periphery, and the core is positioned between the first flange and the second flange.

15. The wearable pack according to claim 9, wherein the first plate comprises a fastener member and the second plate comprises a cover plate, and wherein the cover plate defines an aperture to reveal a segment of the tensioner extending over the cross-member.

16. The wearable pack according to claim 15, further comprising a back plate defining an aperture and matingly engaged with the fastener member on a side thereof opposite to the cover plate, wherein the tensioner further extends through the aperture in the back plate.

17. The wearable pack according to claim 15, wherein the at least one body strap further comprises a sleeve overlying the core, wherein the second flange overlies an outer surface of the sleeve.

18. The wearable pack according to claim 17, wherein the sleeve defines an opening through which a portion of the cover plate extends to permit the cover plate to matingly engage the fastener member.

* * * * *